United States Patent [19]

Hillman

[11] 3,978,644

[45] Sept. 7, 1976

[54] SADDLE

[76] Inventor: Jon G. Hillman, Rte. 1, Box 151, Big Spring, Tex. 79720

[22] Filed: Sept. 9, 1975

[21] Appl. No.: 611,619

[52] U.S. Cl. ..... 54/44
[51] Int. Cl.[2] ..... B68C 1/00
[58] Field of Search ..... 54/44, 37, 45

[56] References Cited

UNITED STATES PATENTS

| | | | |
|---|---|---|---|
| 497,665 | 5/1893 | Hotze | 54/44 |
| 510,684 | 12/1893 | Hester | 54/44 |
| 1,508,631 | 9/1924 | Wellmann, Sr. | 54/44 |
| 3,284,988 | 11/1966 | Veach | 54/44 |
| 3,780,494 | 12/1973 | Nankweil, Jr. | 54/44 |

*Primary Examiner*—Jack Q. Lever
*Attorney, Agent, or Firm*—Wendell Coffee

[57] ABSTRACT

A stainless steel rod frame for a saddle is bent in a general U-shape with an upstanding fork bight. D-ring plates on the rod provide attachment for each D-ring. The saddle built over the frame has an opening through the top of the tree bars to the rod for the stirrup leather so the stirrup leather is free swinging and nonbinding.

15 Claims, 3 Drawing Figures

Fig. 1
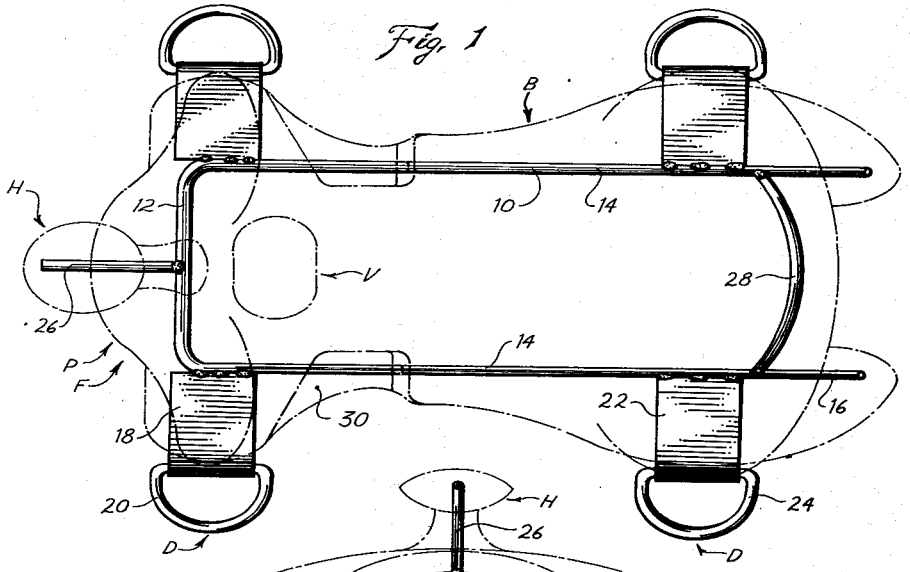
Fig. 2
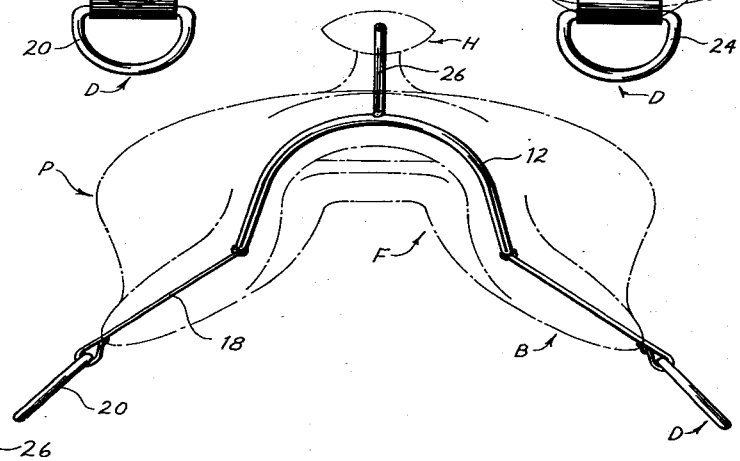
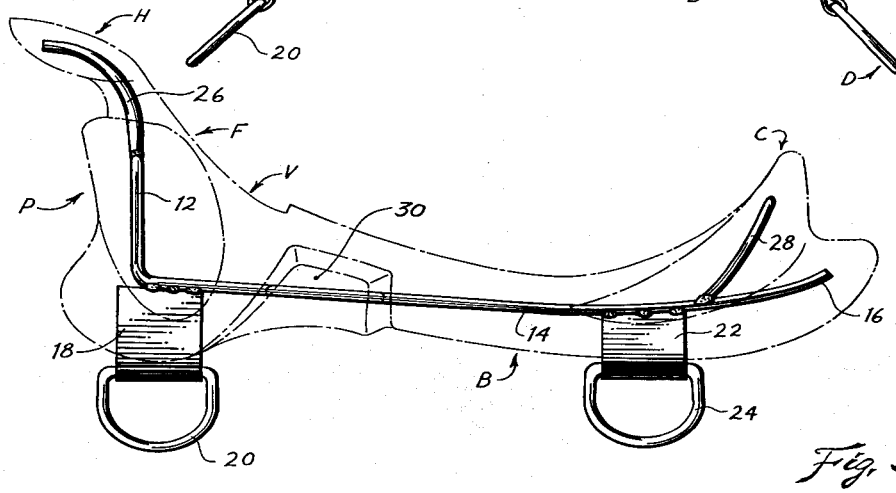
Fig. 3

SADDLE

BACKGROUND OF THE INVENTION

1. Field of the Invention.

This invention relates to saddles and more particularly to saddles having an interior metal tree frame.

2. Description of the Prior Art

Traditionally, the western working saddle was made with a wooden tree, which was rawhide bound, reinforced and shaped. The saddles were extensively used from Canada through the United States into Mexico. Normally, they were used for roping purposes and had a horn upon the fork. For working purposes a cinch was attached in each of the forward and rear rigging rings. If the saddle was to be used in bronc busting, it would most likely not have a horn, and would have a specially shaped pommel.

As stated before, the western working saddle had a wooden frame built up with rawhide to form the saddletree and then covered with leather, making the saddle comfortable for the rider and adding reinforcement as well as eye appeal.

The description of the western working saddle is not to say that there were not other well known saddles such as the military saddle, which was little more than a wooden saddletree.

SZAMEITAT, U.S. Pat. No. 865,661, discloses a saddle having a metal rod frame with wooden tree bars. The rider sat on a trampoline lashed to the metal frame.

With the development of plastics, many people suggested that plastic saddletrees be made. Examples of such is glass fiber-reinforced resin, THOMPSON's Canadian Pat. No. 871,439; HESSLER U.S. Pat. No. 3,293,828, or HOAGLIN U.S. Pat. No. 3,258,894. In each of these cases the saddletree was made of glass fiber-reinforced resin and then the tree covered with leather.

ELLSWORTH U.S Pat. No. 3,157,976 disclosed a saddle competely molded of plastic material and, therefore, not having a leather covering. Applicant understands that Ralide Incorporated of New Braunfels, Texas, markets a saddle under trademark RALIDE, which is a solid plastic saddle tree covered by leather.

SUMMARY OF THE INVENTION

1. New and Different Function.

Stress placed upon working saddles can be quite severe. This is particularly true of saddles used in contests, such as rodeos, where the materials are stressed to their limits.

I have developed a saddle using a metal frame which provides an exceedingly strong saddle. In addition, it is possible to build a saddle which is much lighter than other saddles, even those with considerable less strength. Furthermore, the metal frame provides rigging (by which the saddle is attached to the horse) which cannot be pulled out. I use a stainless steel frame because with it I find the leather rigging and cover are not affected by abrasion or rotting as often results with conventional saddletrees. Also, I have provided a new method of attaching the stirrup leather so the stirrups are unimpeded in their forward swing. The frame is particularly adapted to be used for molded saddles.

When I use the term "molded saddles" in this application I mean to include not only those which have a glass fiber-reinforced resin tree, but also those which are molded of plastic without the intent of using a leather covering thereover.

2. Objects of the Invention

An object of this invention is to build a saddle.

Other objects are to build a saddle that is sturdy, comfortable, durable, lightweight, simple, safe, and versatile, yet inexpensive and easy to manufacture and maintain.

The specific nature of the invention, as well as other objects, uses, and advantages thereof, will clearly appear from the following description and from the accompanying drawing, the different views of which are not necessarily to the same scale.

BRIEF DESCRIPTION OF THE DRAWING:

In the drawing, the saddle is shown in phantom lines and the metal frame in full lines.

FIG. 1 is a top plan view of a saddle according to this invention.

FIG. 2 is a front elevational view of the saddle.

FIG. 3 is a side elevational view of the saddle.

DESCRIPTION OF THE PREFERRED EMBODIMENT

It will be understood that the detailed shape of the saddle generally varies according to the preference of the saddle maker and rider.

Basically the western working saddle will have the following parts: fork "F" which will have shaped pommel "P" therearound; horn "H" upon the top of the fork "F". From the fork F tree bars "B" extend back to cantle "C" at the rear of the saddle; D-rings "D" forward and rear provide for cinch rigging, and vent "V", commonly called a handhold, which is for the primary purpose of lifting the saddle, however, it provides an opening to help keep the horse's back ventilated and cool. The shape of the pommel, cantel, seat, the size of the horn, etc., are all matters of preference and as such do not materially affect this invention.

As shown in the drawing, stainless steel rod 10 forms the basic frame; the rod or frame 10 being bent somewhat U-shaped as seen in FIG. 1. Thus, the frame will have bight 12 at the fork and two side bars 14 extending along the tree bars of the saddle. Referring to FIGS. 2 and 3, there may be seen that the bight 12 is bent upward so that it forms (or perhaps more accurately reinforces) the fork of the saddle. As seen in FIG. 3, the fork bight 12 of the frame is substantially upright, i.e., it forms a right angle with the side bars 14. Also referring to the drawing and particularly to FIGS. 1 and 3, there may been that the side bars are substantially straight and parallel and, thus, they lie in a horizontal plane. Referring to FIG. 3, the side bars 14 angle up at their rear end at 16 slightly. Also, the bars 14 might have other curves or deviations from being straight and parallel. Small deviations are not intended to alter the fact that basically they do extend straight and parallel in a horizontal plane.

Front D-ring plates 18 are attached to the frame 10 at that point the rod is bent from the side bar 14 to the bight 12. The preferred position for the front D-ring 20 is below the fork or the bight 12. Thus, the forward D-ring is attached at the forward most portion of the side bar 14. I prefer to use a single plate butt welded to the rod. I find this construction gives a smooth joint having sufficient strength and also this construction being smooth prevents any damage to the glass fiber-reinforced resin. I also prefer to form the loop to receive the D-ring by rolling it around from the top of the D-ring and welding it back on the underside as particularly seen in FIG. 2. With this arrangement, there is a smooth upper surface so at this point the molded tree may be covered with leather. This provides a smooth path over which the stirrup leather may freely swing.

At this point, it is noted that I have had good success making the main frame of a stainless steel rod 7 mm in diameter and using D-ring plates of stainless steel 1 mm thick and 60 mm wide. However, I in no way intend to be limited by this construction, although I consider stainless steel to be the ideal material, it being compatible with the leather and having great strength. However, if mass production is called for, the frames could be stamped from a stainless steel plate. Persons experienced in metal work will understand how a plate could be cut and stamped with both side bars 14, the bight 12 and the D-ring plates 18 and 22, all from a single sheet.

Normally, the rear D-ring plate will be welded to the side bar 14 just forward of the cantle C. The rear D-ring 24 is attached to the rear D-ring plate 22 and similar as previously described of front D-ring 20.

Normally, horn spike 26 is welded to the top of the bight 12 and is curved to extend up within the horn H as reinforcement therefore. As illustrated, it is a rod of the same size as the rod used in the frame construction. If the frame were to be stamped, obviously, the horn spike 26 would be a portion of the sheet metal of which the entire frame is stamped.

To make an exceedingly strong saddle, cantle loop 28 extends within the cantle from one of the side bars 14 to the other. Since the rear D-ring plates 22 are attached to the side bars 14 immediately forward of the cantle and the cantle loop 28 extends through the cantle, it will be understood that the cantle loop 28 will be proximte the D-ring plate 22. The point of connection to the side bars 14 will vary in direct accordance with the length of seat desired by the rider.

As stated before, the frame which has been described can be used as a frame for a convention wood and rawhide tree. I prefer to use the frame for a glass fiber-reinforced resin tree or, as previously mentioned, the frame is also adaptable to be incorporated in a solid plastic saddle.

In forming the saddle tree, stirrup leather opening 30 is made in the top of the tree bars B so that the side bar 14 of the frame 10 is exposed at this point. Therefore, the stirrup leathers may be attached around the side bars 14. As may be seen, the opening in the tree bars sloped forward and is immediately behind and proximate the front D-ring plate 18. However, the attachment of the stirrup leathers is above the D-ring plates and the D-ring plates are quite thin and the loop comes under the D-rings; therefore, the stirrup leathers can swing forward without binding or impediment. The stirrup leathers are attached to the frame so they are extremely securely anchored.

Therefore, it may be seen that I have provided a strong, lightweight saddle with rigging and stirrup attachments which are almost impossible to pull out as well as providing stirrup leathers attachment so the stirrups have unimpeded, nonbinding forward swing.

As an aid to correlating the terms of the claims to the exemplary drawing, the following catalog of elements is provided:

| | |
|---|---|
| 10 rod or frame | F - fork |

-continued

| | |
|---|---|
| 12 bight | P - pommel |
| 14 side bar | H - horn |
| 16 rear end | B - tree bars |
| 18 front D-ring plate | C - cantle |
| 20 front D-ring | D - D-rings |
| 22 rear D-ring plate | V - handhold |
| 24 rear D-ring | |
| 26 horn spike | |
| 28 cantle loop | |
| 30 stirrup leather opening | |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what in infringement of this patent would be, but are to enable the reader to make and use the invention.

I claim as my invention:

1. Reinforcing structure for a saddle comprising:

a. a stainless steel frame having b. a fork bight at the fork of the saddle and c. two side bars extending along the tree bars of the saddle, d. the side bars being substantially straight and parallel, thus, lying in a horizontal plane, e. the fork bight bend upward from the plane containing the side bars, f. a front D-ring plate on each of the side bars at the forward most point thereof, g. a rear D-ring plate on each of the side bars near the back thereof, h. a loop in the bottom of each D-ring plate, and j. a stainless steel D-ring in each loop.

2. The invention as defined in claim 1 with an additional limitation of k. a horn spike on the fork bight of the frame.

3. The invention as defined in claim 1 with additional limitations of k. a cantle loop, m. said loop extending from and attached to one side bar proximate the rear D-ring plate to the other side bar at the same point thereon.

4. The invention as defined in claim 1 with additional limitations of k. a saddle built around said frame, m. said saddle having a stirrup leather opening from the top of each of the tree bars over each side bar behind and proximate the front D-ring plate, n. thus providing a hanger for a free swinging, nonbinding stirrup leather.

5. The invention as defined in claim 1 with additional limitations of k. a molded saddle tree of synthetic material around said frame, m. said tree covering the entire frame except the loop in the D-ring plates and stirrup leather openings, n. said stirrup leather openings being in the top of the tree behind and proximate the front D-ring plates over the side bars, o. so that a nonbinding stirrup leather may be attached around each side bar.

6. The invention as defined in claim 5 with additional limitations of p. said tree coveed with leather and having added parts thereto, thus g. forming a complete saddle.

7. The invention as defined in claim 1 wherein the bight and side bars of the frame are made of rod and the D-ring plates are stainless steel welded thereto.

8. The invention as defined in claim 7 with an additional limitation of k. a stainless steel horn spike welded to the fork bight of the frame.

9. The invention as defined in claim 7 with additional limitations of k. a cantle stainless steel loop, m. said loop extending from and welded to one side bar forward and proximate the rear D-ring plate to the other side bar at the same point thereon.

10. The invention as defined in claim 7 with additional limitations of k. a saddle built around said frame, m. said saddle having a stirrup leather opening from the top of each of the tree bars over each side bar behind and proximate the front D-ring plate, n. thus providing a hanger for a free swinging, nonbinding stirrup leather.

11. The invention as defined in claim 7 with additional limitations of k. a molded saddle tree of synthetic material around said frame, m. said tree covering the entire frame except the loop in the D-ring plates and stirrup leather openings, n. said stirrup leather openings being in the top of the tree behind and proximate the front D-ring plates, over the side bars o. so that free swinging, nonbinding stirrup leather may be attached around the side bars.

12. The invention as defined in claim 11 with an additional limitation of p. a stainless steel horn spike welded to the fork bight of the frame.

13. The invention as defined in claim 12 with additional limitations of q. a cantle stainless steel loop, r. said loop extending from and welded to one side bar forward and proximate the rear D-ring plate to the other side at the same point thereon.

14. The invention as defined in claim 13 with an additional limitation of s. said frame rod being about 7 mm in diameter and said D-ring plate being about 1 mm thick and 60 mm wide.

15. The invention as defined in claim 14 with additional limitations of t. said tree covered with leather and having added parts thereto, thus u. forming a complete saddle.

* * * * *